United States Patent [19]

Ciula

[11] Patent Number: 5,075,988

[45] Date of Patent: Dec. 31, 1991

[54] SNOWPLOW QUICK MOUNT LIFT ASSEMBLY

[75] Inventor: James C. Ciula, Mentor, Ohio

[73] Assignee: The Louis Berkman Company, Cleveland, Ohio

[21] Appl. No.: 674,447

[22] Filed: Mar. 25, 1991

Related U.S. Application Data

[63] Continuation of Ser. No. 484,870, Feb. 26, 1990, Pat. No. 5,036,608.

[51] Int. Cl.[5] ..... E01H 5/04

[52] U.S. Cl. ..... 37/231; 37/234; 37/236

[58] Field of Search ..... 37/231, 234, 235, 236, 37/232, 233; 293/102, 142; 172/273, 817

[56] References Cited

U.S. PATENT DOCUMENTS

| | | | |
|---|---|---|---|
| 2,667,708 | 2/1954 | Gjesdahl . | |
| 3,214,138 | 10/1965 | Jocher et al. . | |
| 3,410,008 | 11/1968 | Standfuss . | |
| 3,456,369 | 7/1969 | Leposky . | |
| 3,987,562 | 10/1976 | Deen et al. . | |
| 4,187,624 | 2/1980 | Blau . | |
| 4,279,084 | 7/1981 | Low et al. . | |
| 4,369,590 | 1/1983 | Miller | 37/231 |
| 4,439,939 | 4/1983 | Blau | 37/231 |
| 4,658,519 | 4/1987 | Quenzl | 37/231 |
| 4,821,435 | 4/1989 | Pester | 37/231 |
| 4,833,799 | 5/1989 | Harte et al. | 37/231 |
| 4,991,323 | 2/1991 | Benkler | 37/231 X |

FOREIGN PATENT DOCUMENTS

| | | |
|---|---|---|
| 264534 | 1/1950 | Switzerland . |
| 2215282A | 9/1989 | United Kingdom . |

*Primary Examiner*—Randolph A. Reese
*Assistant Examiner*—J. Russell McBee
*Attorney, Agent, or Firm*—Body, Vickers & Daniels

[57] ABSTRACT

A lift mount assembly is provided for a plow blade unit mounted on the frame of a vehicle. The assembly includes a housing unit which is permanently attached to the vehicle frame beneath and behind the bumper including two tube members extending away from the vehicle and similarly recessed. A support unit is designed to be quickly removed from or attached to the housing unit by two tube ends insertable into the housing unit tube members and held in place releasably. The support unit includes a specially configured tube extending forwardly then upwardly away from the vehicle where each end is attached, and meeting at a bight portion. A tubular brace member is spaced apart from and parallel to the bight portion. The support unit further includes a pair of bight portion clevis mounting members on the bight portion and another pair of brace member clevis mounting members on the brace member pivotally attached to the lift arm and the lift arm actuator, respectively.

6 Claims, 3 Drawing Sheets

FIG. 1
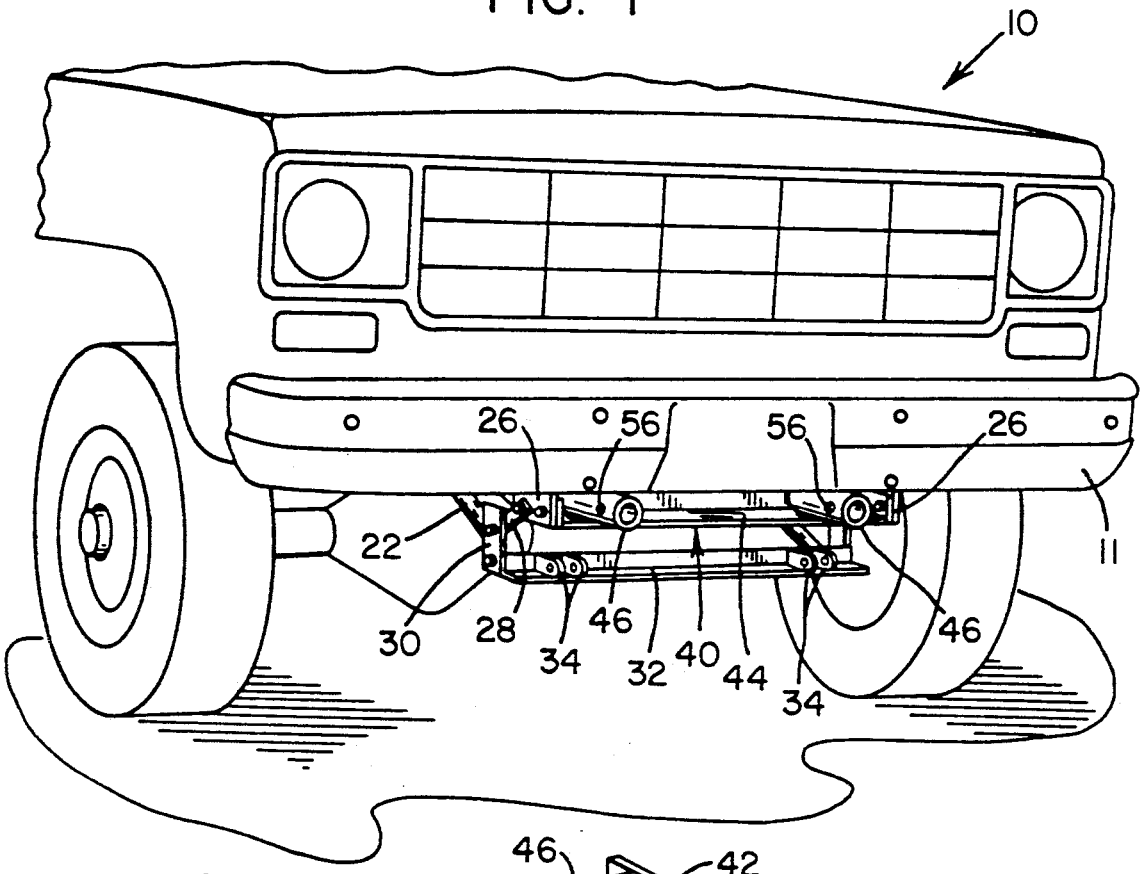
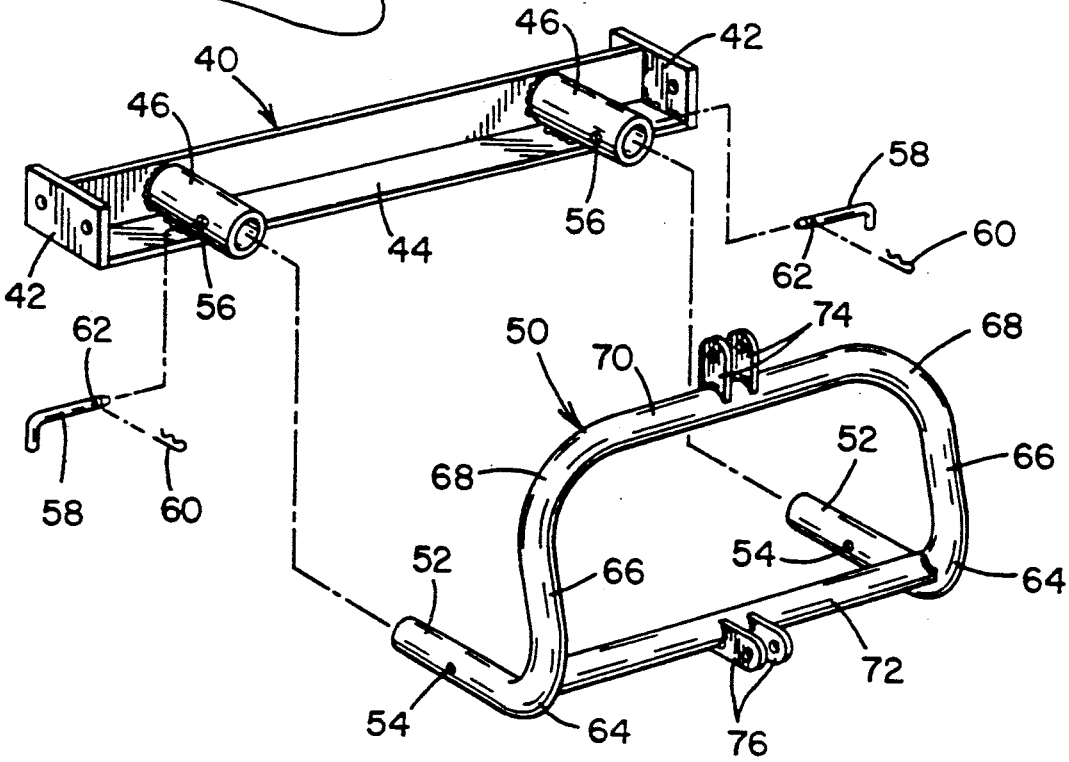
FIG. 2

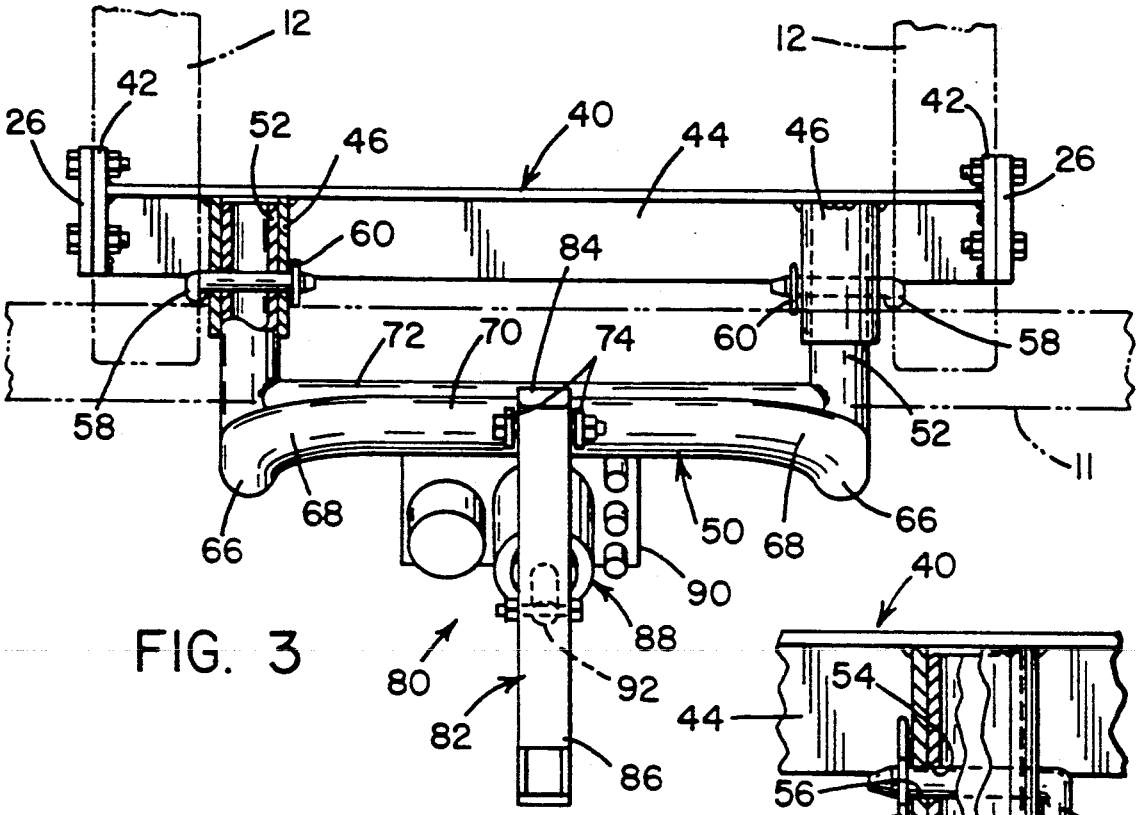
FIG. 3
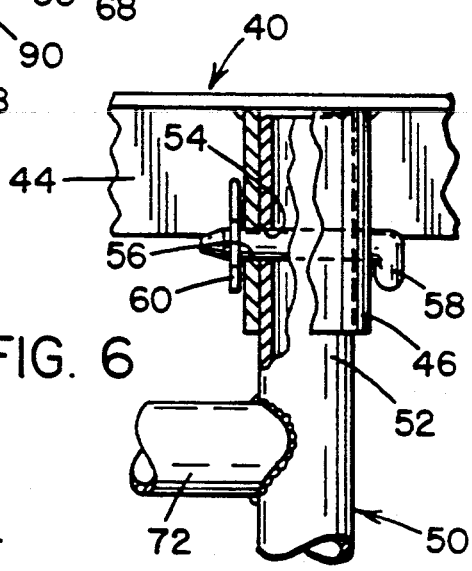
FIG. 6
FIG. 4
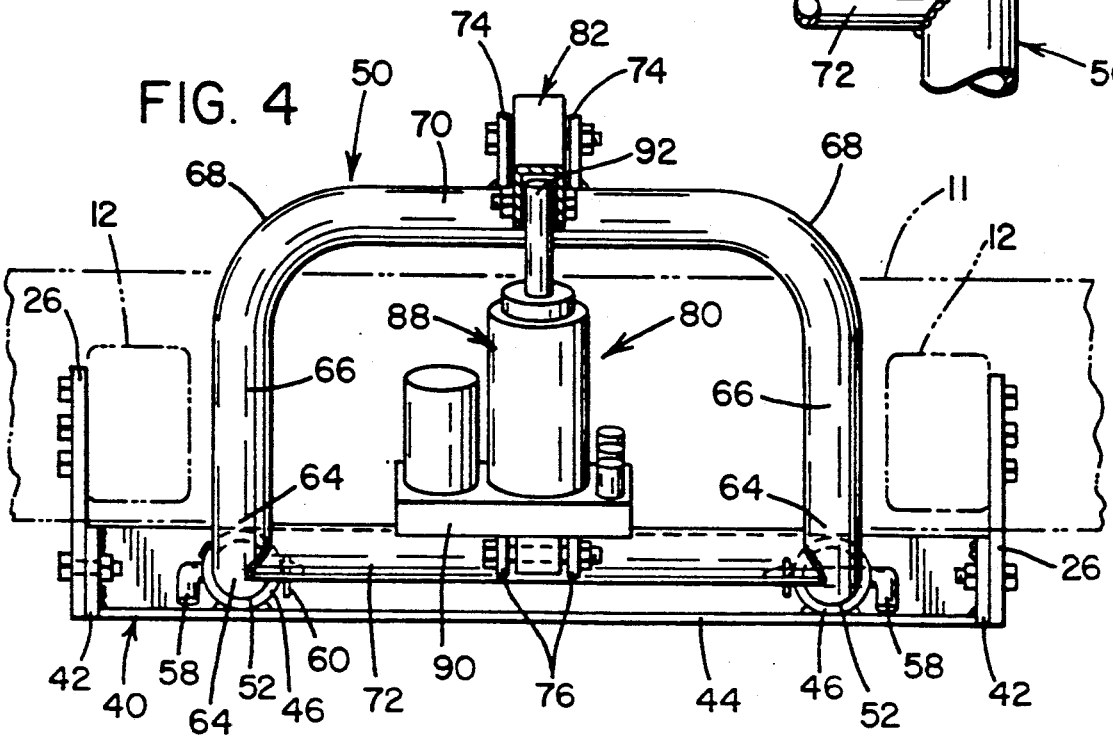

SNOWPLOW QUICK MOUNT LIFT ASSEMBLY

This is a continuation of application Ser. No. 484,870 filed Feb. 26, 1990, now U.S. Pat. No. 5,036,608.

This invention relates to snowplows mountable on automotive vehicles and more particularly to a plow blade lift mount assembly for attaching and detaching the snowplow from the vehicle.

INCORPORATION BY REFERENCE

Low et al U.S. Pat. No. 4,279,084 which issued July 21, 1981 is incorporated hereby by reference and is to be considered as forming part and parcel hereto.

BACKGROUND OF THE INVENTION

It is common for owners to equip commercial vehicles such as jeeps, 4×4's and pick-up trucks with snowplows. Each type of vehicle has a different frame structure and a different bumper to frame relationship. The vehicle must be provided with a plow blade unit support structure which is typically mounted to the frame of the vehicle. The plow blade unit support structure is known as a lift mount assembly. The lift mount assembly serves primarily to raise, lower and support the plow blade, such as by raising the blade above ground during transportation of the snowplow as well as during a snowplow operation, such as when the vehicle is moving backwards. The snowplow is removed for the summer but the frame mount typically stays permanently attached to the vehicle.

Depending on the type of frame mount used, the mount projects out beyond or coplanar with the bumper, thereby defeating the purpose of the bumper. The frame mount becomes a potentially dangerous battering ram when it extends past the bumper and is also subject to being damaged itself due to collision. This can be seen in prior art lift mount assemblies such as those disclosed in Swiss Patent No. 264,534 and U.S. Pat. Nos. 2,667,708 to Gjesdahl; 3,214,138 to Jocher et al; 3,410,008 to Standfuss; 3,456,369 to Leposky; and, 3,987,562 to Dean et al. Additionally, these prior art mount assemblies include one or more of a number of structural characteristics which are disadvantageous i) from the standpoint of weight, ii) exposure to adverse environmental conditions, iii) potential physical damage during non-snowplow use; and iv) cost of manufacture of the lift mount assembly and/or modification of the front of the vehicle to facilitate the attachment of the assembly thereto.

Assignee's U.S. Pat. No. 4,279,084 to Low et al improved on a number of the drawbacks of prior art lift mount assemblies which required modification of the front end of the vehicles to accommodate a lift mount assembly. Low replaced projecting parts of the lift mount assembly with somewhat recessed exposed parts which would not bear the full impact of a collision should the vehicle impact against an object during non-snowplow use.

However, the forwardmost part of the bracket portion of Low's lift mount assembly is located on the same vertical plane as the forwardmost part of the bumper. Therefore, both the bumper and the lift mount bear the brunt of any collision. The battering ram effect is thereby lessened but still exists in Low. Potential damage to the lift mount assembly remains a likelihood on collision. A second problem is that the Low lift mount assembly must be strung up behind the bumper, presenting installation problems. More specifically, the support unit carries a cylinder for raising and lowering the blade. To firmly anchor the lift arm cylinder prior art devices, including Low, require that the support unit be secured to the vehicle frame not only at the bottom, which corresponds to the lower part of the cylinder, but also at the top of the cylinder so that the cylinder is firmly mounted between two vertically spaced points which in turn are firmly fixed, vis-a-vis the frame housing unit to the frame. Since different vehicles have different bumper to frame relationships, Low does require some type of rigging to establish the top mounting point behind the bumper which is troublesome. This problem will be further aggravated should safety regulations be amended to require that bumpers on such vehicles absorb certain speed rated impacts. Such regulation would require the bumper to move relatively toward the frame mounted rigging which could prevent such movement. There is a strong likelihood of damage to the lift mount assembly if the bumper is pushed-in on collision. A third problem is that the exposed parts of Low are exposed to environmental conditions including salt erosion.

SUMMARY OF THE INVENTION

The present invention contemplates a new and improved method for attaching a plow blade unit to a vehicle which overcomes all of the above referred problems and provides an attachment mechanism which can be quickly released without the need of any special tools.

This object, along with other features of the invention, is achieved in a plow blade lift mount assembly comprising two separate units. A housing unit is affixed to the frame of the vehicle and the housing unit has two laterally spaced attachment points situated beneath and behind the bumper of the vehicle. A support unit is provided for mounting the plow thereto, and a fastening mechanism releasably attaches the support unit to the housing unit only at the attachment points so that the support unit and the plow may be easily removed from the vehicle without any permanent lift mount assembly attachments protruding beyond or even with the vehicle's bumper.

In accordance with another aspect of the invention, the support unit includes a tubular member bent into a straight leg portion at one end and a second straight leg portion at its opposite end. The first straight leg portion is generally parallel to the second straight leg portion. Each straight leg portion is affixed to the attachment points by the fastening mechanism. Each leg portion of the support unit terminates in a first bent portion, each first bent portion terminating in an upright portion, and the upright portions are generally parallel to one another and in the same vertical plane as their corresponding leg portion. Each upright portion terminates in a second bent portion, and each second bent portion terminates in a common bight portion extending laterally between and joining said second bent portions so that the portions of the support unit so rigidize said support unit that a third point of attachment fixing the support unit to the vehicle is unnecessary.

In accordance with another feature of the invention the attachment points for the housing unit include tubular members for telescopically receiving the leg portions of the support unit and the fastening mechanism includes the tubular leg portions and the housing unit tubular members having aligned openings and pins extending through said aligned openings so that the support unit may be attached to the housing unit without the need of special tools.

Accordingly, it is a principal object of the invention to provide a quick release lift mount assembly structure attachable at only two points beneath and behind the bumper so that upon removal no permanently attached mounting parts protrude past, even to or over the bumper.

It is an object of the present invention to provide improvements in plow blade lift mount assemblies mountable on a vehicle for elevating and lowering a plow blade unit mounted on the vehicle.

Another object is the provision of a lift mount assembly of the foregoing character which enables quick release of the support portion of the assembly from the housing unit thereof during periods of non-snowplowing use of the vehicle.

Still another object is the provision of a lift mount assembly of the foregoing character which enables quick release and removal and at the same time protects against unintentional separation of component parts from the support unit during snowplowing operation.

Yet another object is the provision of a lift mount assembly associated with a vehicle frame completely independent of the vehicle bumper.

Another object of the present invention is the provision of a lift mount assembly of the foregoing character in which the structure and location of the housing unit in relation to the bumper and vehicle body promote the safety of the vehicle during non-snowplow use of the vehicle with the support unit removed.

Still a further object is to provide a lift mount assembly which is less expensive to manufacture due to the tubular construction of the support unit.

Still a further object is the provision of a lift mount assembly which is of light weight construction, which has structural integrity with respect to loads imposed thereon when supporting a given plow blade in elevation, which promotes the long life of component parts of the assembly and which minimizes maintenance and replacement cost with respect thereto by enabling removal of the support unit from the housing unit of the assembly.

Yet another object of the invention is a rigid support unit for use in any type of lift assembly for mounting and elevating a snowplow which is secured to the vehicle only by two attachment points situated underneath and behind the vehicle's bumper.

BRIEF DESCRIPTION OF THE DRAWINGS

The foregoing objects, and others, will in part be obvious and in part be pointed out more fully hereinafter in conjunction with the description of the accompanying drawings illustrating embodiments of the invention and in which:

FIG. 1 is a perspective view of the front end of an automotive vehicle having the housing unit of the present invention mounted thereon;

FIG. 2 is an exploded view showing the housing unit and support unit of the assembly along with their removable connectors;

FIG. 3 is a top view of the connected housing unit and support unit of the present assembly attached to the frame of an automotive vehicle;

FIG. 4 is a front elevation view of the connected housing unit and support unit of the present assembly attached to the frame of an automotive vehicle;

DESCRIPTION OF PREFERRED EMBODIMENTS

Figure 5:
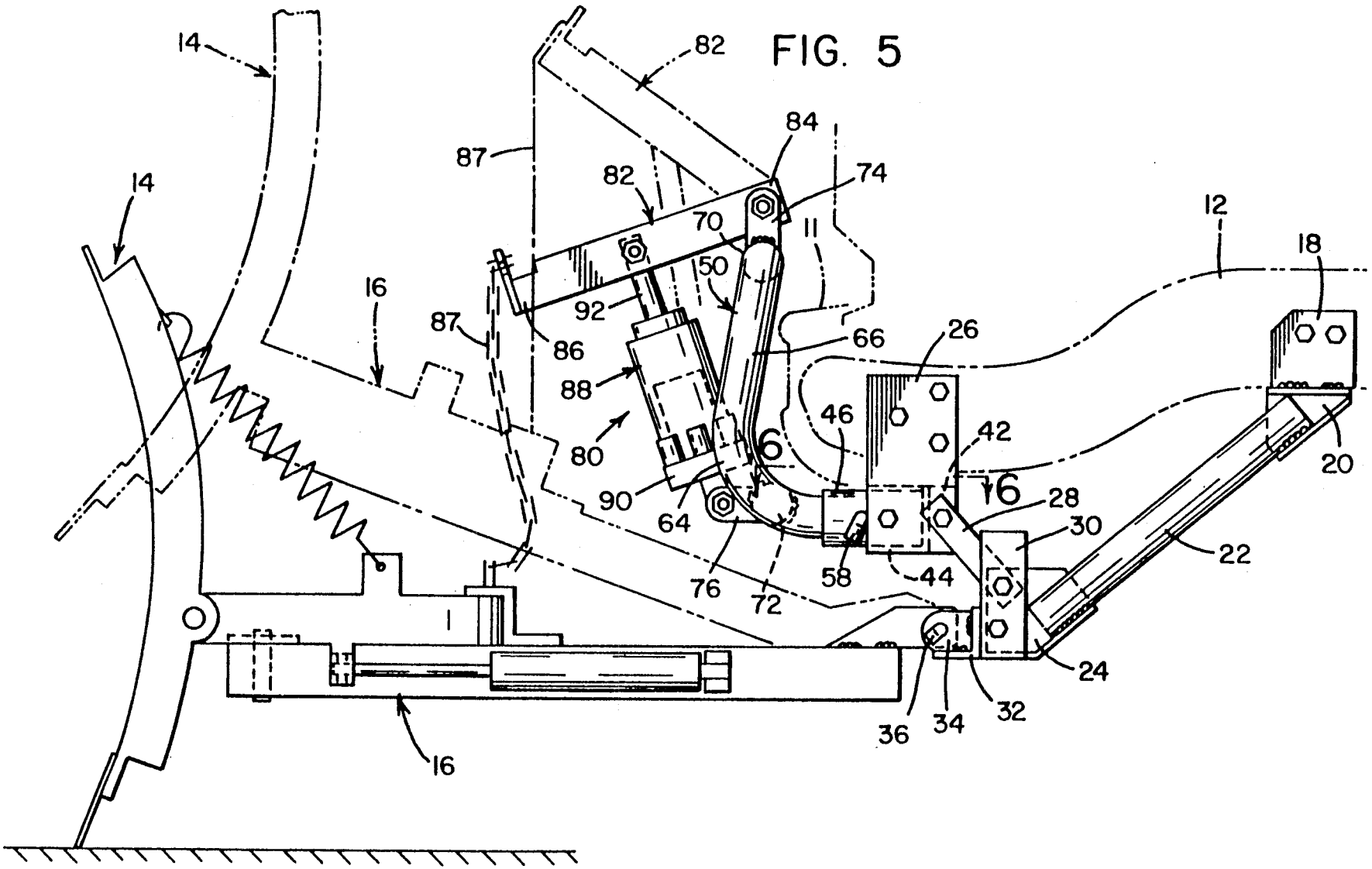
FIG. 5 is a side elevation view of the lift mount assembly showing a lift arm unit associated therewith and with supporting structure for a snowplow blade unit shown beneath the vehicle frame attached to the snowplow blade unit; and, FIG. 6 is an enlarged top view taken on line 6—6 of FIG. 5 of the releasable connection between the support unit tube legs and the housing unit tube members.

Referring now in greater detail to the drawings wherein the showings are for the purpose of illustrating preferred embodiments of the invention only and not for the purpose of limiting the invention, a vehicle 10 such as a commercial pickup truck is shown in FIG. 1. Vehicle 10 includes a pair of laterally spaced apart longitudinally extending frame members 12 as best indicated in phantom dot-dash lines shown in FIGS. 3 and 5. Such frame members are generally of channel or box construction and have forward ends terminating adjacent the front of the body of the vehicle. Vehicle 10 and frame members 12 are shown as depicting only one type of vehicle frame arrangement to which the present invention can be attached.

Plow blade unit 14 is connected to plow attachment 16 which is pivotally and releasably interconnected with the vehicle frame therebeneath to enable detachment of the blade unit from the vehicle as seen in FIG. 5. Plow blade unit 14 and plow attachment 16 are shown as depicting only one type of plow attachment mechanism which would work with the present invention.

In the preferred embodiment, plow attachments 16 are attached to the frame members 12. As seen in FIG. 5, frame members 12 include two support strut mounting plates 18 attached by nut and bolt connectors. Support strut mounting plates 18 are attached to laterally extending support strut mounting brackets 20 such as by welding. Support strut mounting brackets 20 are attached to two support struts 22 such as by welding. The opposite ends of support struts 22 are attached to blade unit mounting brackets 24 such as by welding. Blade unit mounting brackets 24 are attached to the vehicle frame by a second connection also. Frame members 12 include two vehicle frame plates 26 attached by nut and bolt connectors. Vehicle frame plates 26 include two strap members 28 attached by nut and bolt connectors. Strap members 28 are attached to two plow attachment mounting plates 30 by nut and bolt connectors. Plow attachment mounting plates 30 are attached to blade unit mounting brackets 24 by nut and bolt connectors, thereby providing additional support to the connection of the blade unit mounting brackets to the vehicle frame.

Plow attachment mounting plates 30 are interconnected with the rear side of a connected blade unit support member 32 such as by welding. Blade unit support member 32 is provided with laterally spaced apart blade unit clevis pairs 34, attached such as by welding. As seen in FIGS. 1 and 5, plow attachment 16 is pivotally and releasably attached to blade unit clevis pairs 34. Each blade unit clevis pair 34 is adapted to receive an inner mounting portion of a corresponding member of plow attachment 16 therebetween. The blade unit clevis pairs 34 and mounting portions of the plow attachment 16 are provided with aligned openings receiving corresponding L-shaped pins 36 by which the blade unit is pivotally and releasably connected with blade unit clevis pairs 34. Cotter pins, not shown, are adapted to be inserted through openings in L-shaped pins 36 to releasably hold them in place.

Plow blade unit 14, plow attachment 16 and blade unit clevis pairs 34 are typical of arrangements for detachably mounting a snowplow to a vehicle and reference may be had to Low U.S. Pat. No. 4,279,084 for a further detailed description of attachment 26. For example, attachment 16 carries a cylinder which limits the blade angle relative to vehicle 10. For purposes of this invention it is significant to note that attachment 16 and blade unit clevis pairs 34 permit plow blade unit 14 to swivel in a vertical plane. Alternative arrangements for attaching the plow blade unit may be used in conjunction with the present invention. For example, it is conceptually possible to secure plow attachment 16 to the support unit of the present invention.

As already noted, vehicle frame members 12 are connected by nut and bolt assembly to vehicle frame plates 26 as seen in FIG. 5. As seen in FIG. 2, the present invention includes a housing unit 40 of the lift mount assembly including a pair of housing unit mounting plates 42 each securely fastened to one of two corresponding vehicle frame plates 26 such as by nut and bolt assemblies shown in FIGS. 3 and 5. Vehicle 10 includes a bumper 11. As seen in FIG. 5, housing unit mounting plates 42 are behind bumper 11 and independent of bumper mounting supports, not shown, which connect the bumper 11 to the frame members 12. FIG. 2 shows that housing unit 40 includes an L-shaped cross-member 44 which is rigidly secured to housing unit mounting plates 42 such as by welding. Two housing tube members 46 extend horizontally forward from and are rigidly secured to L-shaped cross-member 44 such as by welding. As shown in FIG. 2, and as will be described in greater detail hereinafter, the present invention includes a support unit 50 which is removably connected to housing unit 40. Support unit 50 includes tubular straight leg portions 52 which are insertable into housing tube members 46. Straight leg portions 52 and housing tube members 46 include aligned straight leg openings 54 and housing tube openings 56 respectively and are releasably connected by use of L-shaped pins 58 which extend through openings 54 and 56. Cotter pins 60 are adapted to extend through openings 62 in L-shaped pins 58 to releasably hold the latter pins in place. This arrangement is merely one preferred embodiment. Any other arrangement can be used as long as the housing unit results in two laterally spaced attachment points secured to structures permanently affixed to the vehicle frame which define two points in space positioned beneath and behind the bumper whereat the support unit is removably mounted.

As shown in FIG. 2, straight leg portions 52 extend forwardly outward from their connection with housing tube members 46. Housing tube members 46 and straight leg portions 52 are located on the same horizontal plane. The center lines of both the housing tube members 46 and straight leg portions 52 are 19.75 inches apart in the preferred embodiment. Flat leg portions 52 extend outward 5.00 inches before bending upward and back toward the vehicle to form tube bent portions 64 which are circular about a 4 inch radius. The tube bent portions lead into straight tubular upright portions 66 which are at an 80° angle to the straight leg portions 52. The upright portions 66 lead into second bent portions 68. Second bent portions 68 lead into a bight portion 70 which connects second bent portions 68. The center line of the bight portion 70 is located 7.75 inches from the vertical plane connecting the ends of straight leg portions 52 and 12.00 inches from the horizontal plane connecting the center lines of straight leg portions 52. The outside diameter of all tube portions is 1.90 inches. The 80° angle is a preferred embodiment. Any angle between 45° and 90° would be sufficient depending on the dimensions of other tube portions. Bent portions 64 are connected by a brace member 72 spaced apart from and parallel to bight portion 70. Brace member 72 is rigidly connected to bent portions 64 of support unit 50 such as by welding. Brace member 72 is of tubular construction and is circular in cross-section, as are straight leg portions 52, bent portions 64, upright portions 66, second bent portions 68 and bight portion 70. This promotes minimizing the weight of the support unit and thus the overall weight of the lift mount assembly. The inherent strength of the bent tube in the configuration of the support unit 50 of the preferred embodiment eliminates the need for a fixed point of attachment above the bumper. The tube is simple and inexpensive to form, such as by methods used to form automotive exhaust pipes and the like. If desired, the cross-sectional shape of the tube for certain portions thereof could be pressed or crimped into a non-circular shape for load strengthening purposes. While a cylindrical shape for the tube is used to form support unit 50, other tubular cross-sectional configurations could be used. In addition, support unit 50 could be further strengthened by using a tube within a tube over certain portions of its bent configuration.

Because the present invention eliminates the fixed point above the bumper, there is no protrusion of the permanently affixed part of the lift mount assembly during non-snowplow use. This eliminates the battering ram problems of the prior art. Furthermore, there is no need to string the lift mount assembly up behind the bumper as in Low. That configuration was problematic due to potential damage to the assembly upon impact of the bumper with an object as well as being problematic due to inconvenience in installation. The present invention has universal application since it can fit all kinds of vehicle frames, a quality that was missing in the prior art.

Bight portion 70 is provided intermediate its opposite ends with a pair of upwardly extending bight portion clevis members 74 each rigidly connected to bight portion 70 such as by welding. Brace member 72 is provided intermediate its opposite ends with a pair of brace member clevis members 76 extending horizontally away from the front of the vehicle, each rigidly connected to brace member 72 such as by welding. The angles of attachment of both pairs of bight portion clevis members 74 and brace member clevis members 76 are preferred embodiments and other angles could be used. The clevis members are attached to the supporting unit of the invention in order to provide attachment means to a standard lift arm unit which is not a part of this invention. However, the lift arm unit and its connection to the supporting unit will be described hereinafter as part of the preferred embodiment.

As seen in FIG. 5, a lift arm unit 80 includes a lift arm member 82 having inner and outer ends 84 and 86, respectively. Inner end 84 of the lift arm is disposed between bight portion clevis members 74 and is pivotally interconneted therewith by nut and bolt connection. Outer end 86 is connected to chain 87 which is connected at its other end to plow blade unit 14 in order to lift plow blade unit 14. Lift arm unit 80 further includes an extendable and retractable lift arm actuator 88 which is pivotally interconnected with brace member clevis members 76. Lift arm actuator 88 has upper and lower opposite ends with respect to the direction of extension and retraction thereof. The lower end is pivotally interconnected with brace member clevis members 76 by nut and bolt connection. The upper end of lift arm actuator 88 is pivotally connected with lift arm member 82 by nut and bolt connection intermediate inner and outer ends 84 and 86 thereof. Any suitable extendable and retractable lift arm actuator can be employed, and in the embodiment illustrated, lift arm actuator 88 includes a lift arm actuator base and body portion 90 pivotally attached to brace member clevis members 76 on brace member 72 by means of a nut and bolt assembly, and a lift arm actuator ram member 92 having its outer end pivotally interconnected intermediate lift arm member 82 by means of a nut and bolt assembly.

It will be noted at this point that the lift mount assembly in its entirety is independent of any connection with vehicle bumper 11. It will be noted too, that brace member clevis members 76 provide for lift arm actuator 88 to be located in front of and closely adjacent to the vehicle bumper 11, thus providing for the assembly to be structurally compact. The 80° angle between the straight leg portions 52 and the upright portions 66 of support unit 50 allow the lift arm unit 80 to be disposed somewhat more vertically which makes the assembly more compact. It will also be appreciated from the foregoing description and from FIG. 2 that support unit 50 is adapted to be quickly removed as a unit or while in connection with the lift arm unit 80 from the housing unit 40 of the assembly simply by removing cotter pins 60 from the openings 62 in L-shaped pins 58, then pulling L-shaped pins 58 from aligned leg openings 54 and housing tube openings 56 in straight leg portions 52 and housing tube members 46, respectively, then removing straight leg portions 52 from housing tube members 46 into which they had been inserted. Reassembly of support unit 50 with housing unit 40 is likewise readily achieved simply by inserting straight leg portions 52 into housing tube members 46, inserting L-shaped pins 58 into aligned leg openings 54 and housing tube openings 56 in straight leg portions 52 and housing tube members 46, respectively, and then providing for retention of L-shaped pins 58 by inserting cotter pins 60 through openings 62 in L-shaped pins 58.

While considerable emphasis has been placed on the specific structure of the lift mount assembly illustrated and described herein and the structural interrelationship between the component parts thereof and between the assembly and the vehicle on which it is mounted, it will be appreciated that many embodiments of the invention can be made and many changes can be made in the embodiments herein disclosed without departing from the principles of the present invention. In this respect, the housing tube members could be insertable into the tube leg portions or the inner tube in either arrangement could actually be a solid member. More than two tube leg portions could be used, insertable into an equal number of housing tube members. The tubes could be located in different locations as well. Further, the bight portion of the support unit could be a separate portion rigidly connected to the upright tube portions such as by welding instead of being one continuous tube. Also, the cross-sectional configuration of any of the tube members could be other than circular, and could be of solid construction. Further, releasable connections other than by L-shaped pins and cotter pins could be used to connect the tube leg portions with the housing tube members or to connect the plow blade unit with the blade unit clevis pairs. Moreover, nut and bolt assembly connectors could be replaced by other pivotal connectors. Still further, the lift mount assembly can be packaged as an individual unit or as part of a lift arm unit and lift mount assembly package or as part of a complete snowplow blade, lift arm unit and lift mount assembly package. More specifically, while the invention has been described as a lift mount assembly including some type of housing unit 40 to define two attachment points in space, the invention in a broader sense is simply the provision of a tubular lift support unit 50 which has two leg attachment points for mounting to the vehicle frame. These and other changes in the embodiments herein illustrated and described, as well as other embodiments of the invention, will be obvious or suggested to those skilled in the art upon reading and understanding the specifications. It is my intention to include all such modifications and alternatives insofar as they come within the scope of the invention.

Having thus described the invention, it is claimed:

1. A plow blade lift mount assembly for attachment to a vehicle to raise and lower a plow vertically pivotable on the vehicle frame, said assembly comprising a housing unit affixed to the frame of said vehicle, said housing unit having two laterally spaced attachment points situated beneath and behind the bumper of said vehicle;

a support unit for mounting a plow blade lift means on said housing unit;

fastening means for releasably attaching said support unit to said housing unit only at said attachment points whereby said support unit may be easily removed from said vehicle without said housing unit protruding beyond or even with said vehicle bumper; and said support unit comprising a one-piece inverted U-shaped tubular member having a straight bight portion and a pair of laterally bent parallel extending straight end leg portions affixed to said attachment points by said fastening means, said bight portion extending laterally between and joining the side portions of the U-shaped support unit whereby the said support unit is so rigidized that a third point of attachment fixing the support unit to the vehicle is unnecessary.

2. An assembly as defined in claim 1, wherein said tubular support unit further includes a tubular brace member extending parallel to the said bight portion and connecting the said end leg portions whereby said support unit is further rigidized.

3. An assembly as defined in claim 2, wherein the said lift means comprises a lift arm pivotally mounted at one end on said bight portion and provided at its other end with a lift chain for connection to said plow, and an actuator for raising and lowering the plow on the vehicle, said actuator being pivotally mounted on said brace portion and having an actuator ram member pivotally connected to said lift arm intermediate the ends thereof.

4. A plow blade lift mount assembly for attachment to a vehicle to raise and lower a plow vertically pivotable on the vehicle frame, said assembly comprising a housing unit affixed to the frame of said vehicle and including a support plate extending laterally between and rigidly attached to the longitudinal members of the vehicle frame and a pair of short tubular mount members fixedly attached to and extending forwardly from said support plate in laterally spaced apart relation thereon but located entirely rearwardly of and below the bumper of the vehicle;

a support unit adapted to support a plow blade lift means including an actuator for raising and lowering the plow blade on the vehicle, said support unit comprising a one-piece inverted U-shape tubular member having a straight bight portion and a pair of laterally bent parallel extending straight end leg portions adapted for telescoping engagement with said tubular mount members to mount the support unit in place on said housing unit, said bight portion so rigidizing said support unit that a third point of attachment fixing the support unit to the vehicle is unnescessary; and fastening means for releasably locking said straight leg portions of said support unit in telescoped engagement with said tubular mount members whereby said support unit may be easily removed from said vehicle without said tubular mount members protruding beyond or abreast of said vehicle bumper.

5. An assembly as defined in claim 4, wherein the said tubular mount members are laterally spaced apart a substantial narrower distance than the lateral spacing between the longitudinal members of the vehicle frame.

6. A frame mount for detachably supporting a plow blade lift mount assembly on the frame of a vehicle having a front bumper, said frame mount comprising a support plate extending laterally between and rigidly attached at its opposite ends to the forward ends of the spaced longitudinally extending frame members of a vehicle chassis, and a pair of short tubular mount members fixedly attached to and extending forwardly from said support plate in laterally spaced apart parallel relation thereon but located entirely rearwarly of said bumper in exposed relation therebelow, said lift mount assembly comprising a one-piece U-shaped tubular support member including a pair of parallel extending side arm portions joined at one of their respective ends by a straight bight portion and terminating at their other ends in laterally bent end leg portions extending parallel to one another and adapted for releasably fastened telescoped engagement with said tubular mount members to thereby mount the lift mount assembly in place on the vehicle with the said tubular support member in laterally extending upright position on the vehicle adjacent and in front of the said bumper with its said bight portion extending horizontally across the front of the vehicle, the said tubular support member including a tubular brace member extending parallel to the said bight portion and rigidly fastened between the said arm portions at their junctions with the said end leg portions, said lift mount assembly including a plow blade lift arm pivotally mounted at one end on and extending generally forwardly from the said bight portion of said support member for vertical pivotal movement, a chain attached to the other end of said lift arm for connection to a plow blade unit pivotally mounted to the vehicle frame at points below and behind the bumper for vertical swing movement, and an extensible and retractable lift arm actuator including a body portion pivotally mounted in a generally vertical position on the said brace portion of said tubular support member and provided with an actuator ram member pivotally connected to said lift arm intermediate its ends for pivotally raising and lowering it to raise and lower the said plow blade unit.

* * * * *